United States Patent [19]

Bergler

[11] Patent Number: 4,881,585

[45] Date of Patent: Nov. 21, 1989

[54] BENCH TYPE MILLING CUTTER

[75] Inventor: Otto Bergler, Mühlacker-Lomersheim, Fed. Rep. of Germany

[73] Assignee: Black & Decker Overseas AG, Vaduz, Liechtenstein

[21] Appl. No.: 263,263

[22] Filed: Oct. 27, 1988

[30] Foreign Application Priority Data

Oct. 30, 1987 [DE] Fed. Rep. of Germany ..... 3736757

[51] Int. Cl.[4] ..... B27C 5/00

[52] U.S. Cl. ..... 144/134 A; 144/1 G; 144/134 R; 409/211; 409/228

[58] Field of Search ..... 409/201, 204, 206, 211, 409/228; 144/1 R, 1 G, 134 R, 134 A

[56] References Cited

U.S. PATENT DOCUMENTS

| | | | |
|---|---|---|---|
| 1,275,215 | 8/1918 | Buss | 144/134 A |
| 1,335,547 | 3/1920 | Bartholomew et al. | 144/134 A |
| 2,353,202 | 7/1944 | Taufz | 144/134 A |
| 2,744,550 | 5/1956 | Knapp | 144/134 A |
| 3,008,501 | 11/1961 | Hammer | 144/1 G |
| 3,710,833 | 1/1973 | Hammer et al. | 144/134 A |

FOREIGN PATENT DOCUMENTS 3337261 7/1985 Fed. Rep. of Germany .

*Primary Examiner*—W. Donald Bray
*Attorney, Agent, or Firm*—Burns, Doane, Swecker & Mathis

[57] ABSTRACT

A bench type milling cutter includes a bearing block assembly which is a bearing block assembly which is carried by a carrier and which is linearly vertically adjustable relative to the carrier by means of a manual actuator. The carrier, in turn, is mounted on a slide for rotation relative to the slide within a vertical plane containing the tool axis, such rotation created by a manual actuator. The slide is movable horizontally relative to the work bench so that the tool may be displaced horizontally in relation to the workpiece.

24 Claims, 4 Drawing Sheets

BENCH TYPE MILLING CUTTER

BACKGROUND AND OBJECTS OF THE INVENTION

The invention concerns a bench type cutter of the type in which a cutting tool is mounted on a work bench. The tool is affixed to a tool axle, the ends of which are rotatably held in upper and lower legs, respectively, of a bearing assembly. A connector portion of the bearing assembly interconnects the legs and passes through a passage in the work bench.

A bench type milling cutter of this type is known from DE-OS 33 37 265 in which a milling cutter is attached to a vertical axle, the axle being rotatably mounted in upper and lower bearings. The lower bearing is mounted on a lower bearing holder carried by the lower horizontal leg of a U-shaped bearing block. The upper bearing is attached to an upper horizontal leg of the bearing block. The bearing block is attached pivotably to a base, the latter being affixed to the underside of a horizontal workbench table. The bearing block is thus rotatably about a horizontal axis to enable the inclination of the axle to be varied. By raising and lowering the height of the lower bearing holder relative to the upper leg, the height at which the milling tool is disposed above the table can be varied. A disadvantage of such structure involves the fact that all adjusting operations, such as the setting of the inclination angle, and the adjustment of the tool height is possible only by the actuation of devices located under the table. This is cumbersome and expensive.

It is the object of the invention to provide a bench type milling cutter of the afore-mentioned type such that the setting and working conditions are simplified. This object is attained in the case of a bench type milling cutter of the afore-mentioned type wherein a bearing block assembly is carried by a carrier and is linearly vertically adjustable relative to the carrier by means of a manual actuator. The carrier, in turn, is mounted on a base for rotation relative to the base within a vertical plane containing the tool axis, such rotation created by a manual actuator. By means of this arrangement, in which the adjusting controls for the milling assembly are no longer located under the table but rather are more readily accessible, it is possible in a simplified manner to actuate the controls from above the work bench, especially for adjusting the height of the milling cutter. A more simplified operation, also making possible more accurate milling operations, is thereby created.

Preferably, the base comprises a slide which is movable horizontally relative to the work bench so that the tool may be displaced horizontally in relation to the workpiece so that processing that is not possible with the known bench type milling tools, may be carried out without reclamping the workpiece.

THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 1:
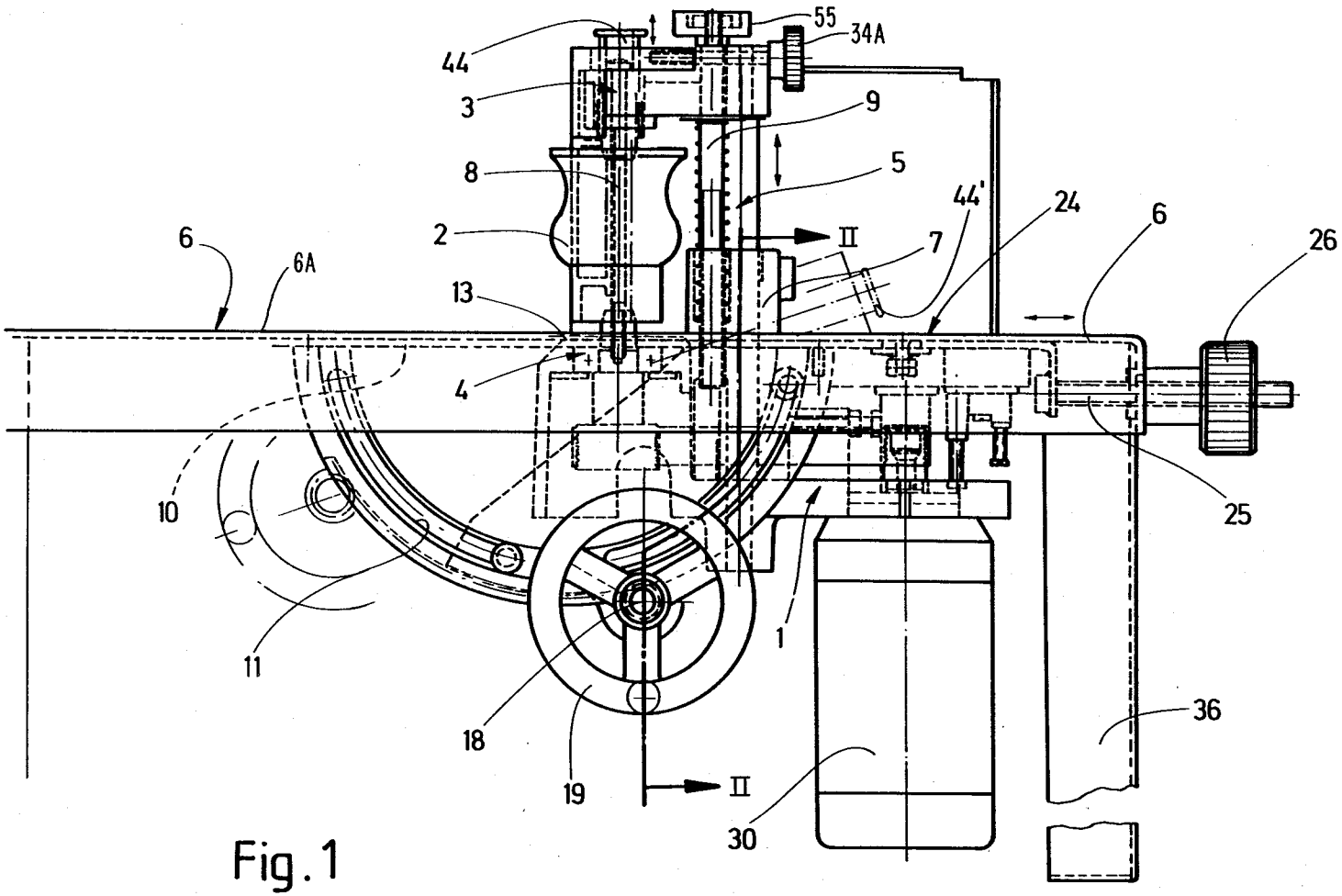
FIG. 1 is a schematic lateral elevational view of a bench type milling cutter according to the invention.
Figure 2:
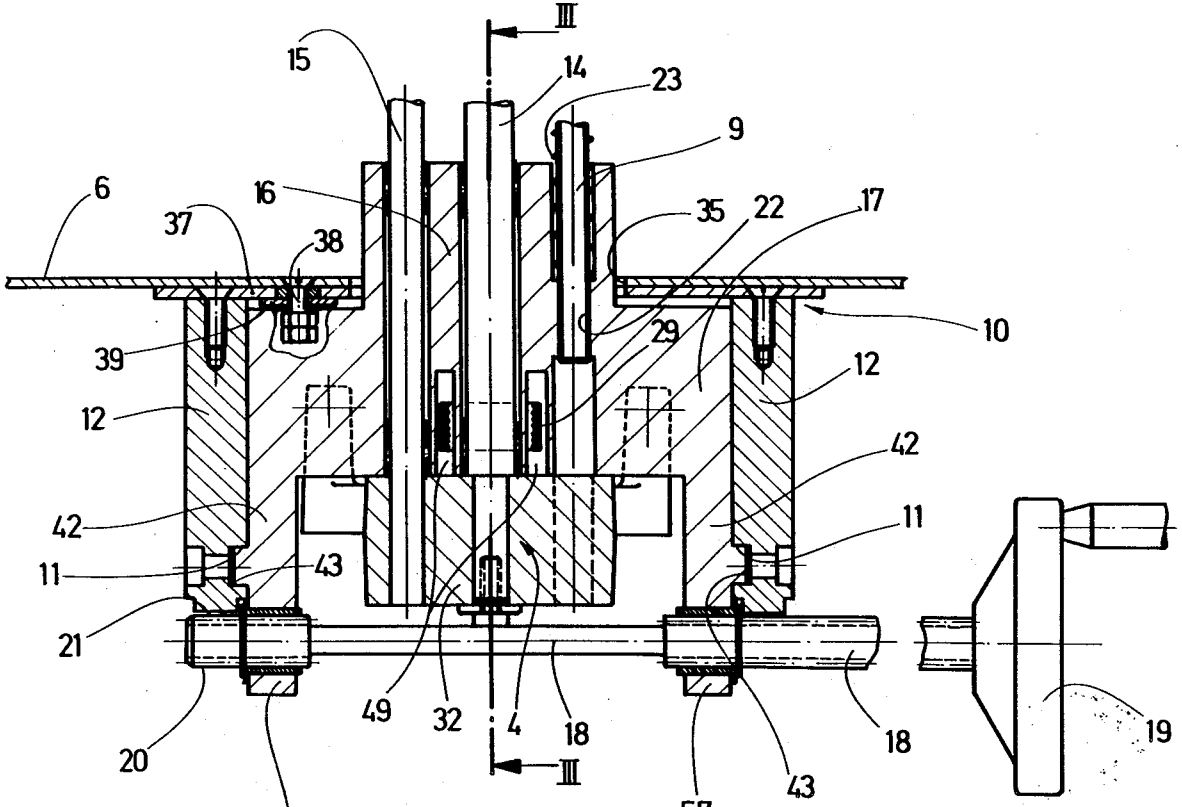
FIG. 2 is a vertical section through the bench type milling cutter taken along the line II—II of FIG. 1, with parts of the assembly broken away.

It is seen from FIG. 1 that the novel bench type milling cutter comprises a work bench (6), a horizontal work table (6A) of which is supported in a known manner by means of column legs on the ground. The table is able to support a workpiece (not shown). Mounted to the work bench is a tool-carrying module comprising a base or slide (10), a carrier (17), and a bearing assembly (3, 4, 14, 15) as will be explained hereinafter. The slide (10) is located adjacent the underside of the table and is horizontally linearly displaceable in a direction parallel to the plane of the table (6A). The slide includes a guide plate (37) and downwardly depending jaws (12) arranged parallel to each other. The slide (10) constructed in this manner is held displaceably on the bottom side of the table (6A) by screws (38) mounted in the table (6A). The screws project through guide slots (27) in the plate (37), thereby enabling the plate (37) to be displaceable relative to the bench (6) in the direction of the guide slots (27). A clamping plate (39) is pressed against the plate (37) by nuts to hold the plate (37) in adjusted positions. The guide plate (37) is provided on one end with a rim (40) on which an adjusting spindle (25) is fixedly mounted with its axle parallel to the plate (37). This adjusting spindle (25) is received threadedly in an adjusting nut (26), which is supported rotatingly on an outer edge of the work bench (6) and is equipped with knurling (41) for manual actuation. The afore-mentioned linear displacement of the slide (10) may therefore be effected by rotating the adjusting nut (26).

Figure 3:
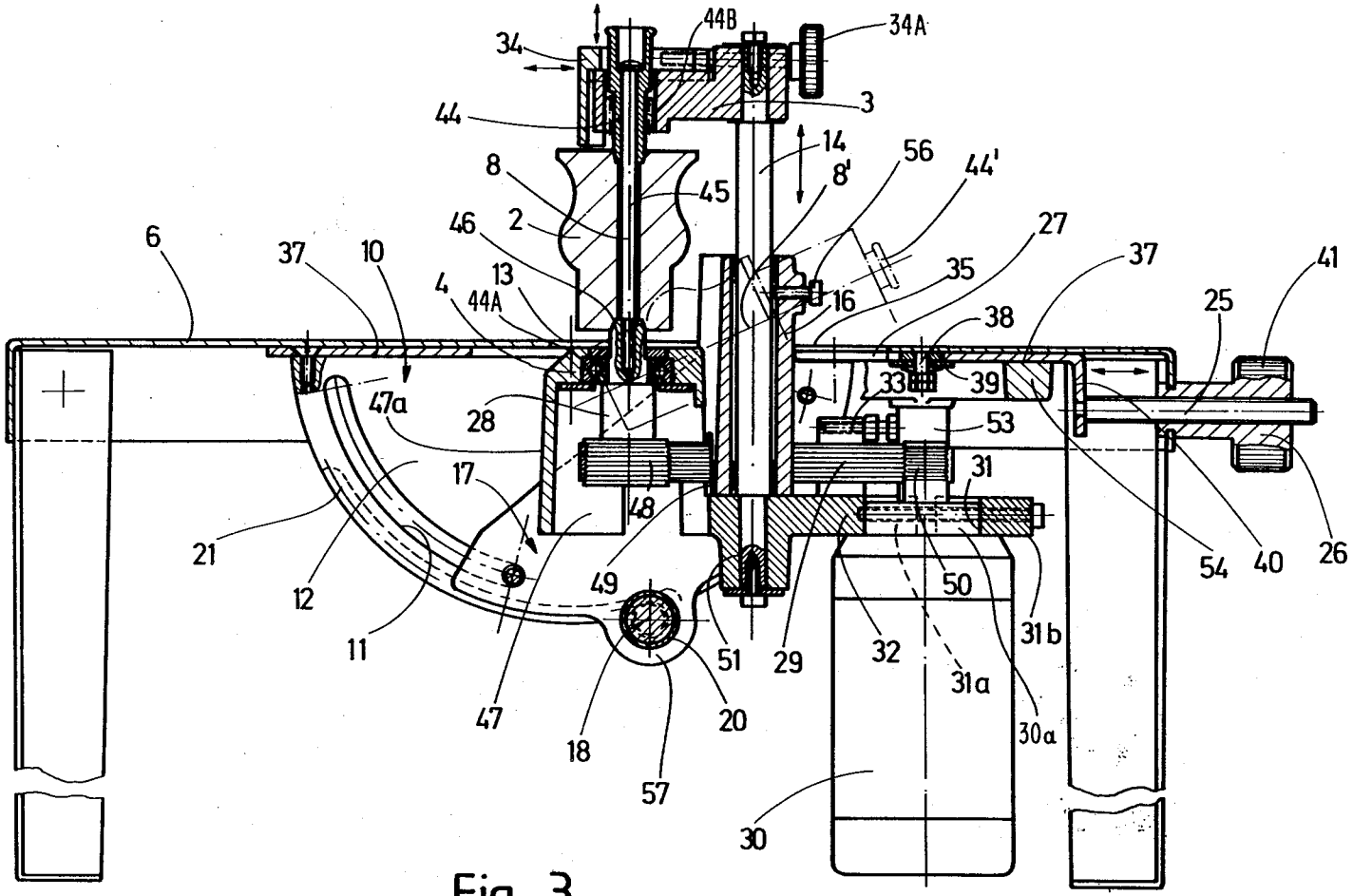
FIG. 3 is a vertical sectional view through the milling cutter taken along the line III—III of FIG. 2.
Figure 4:
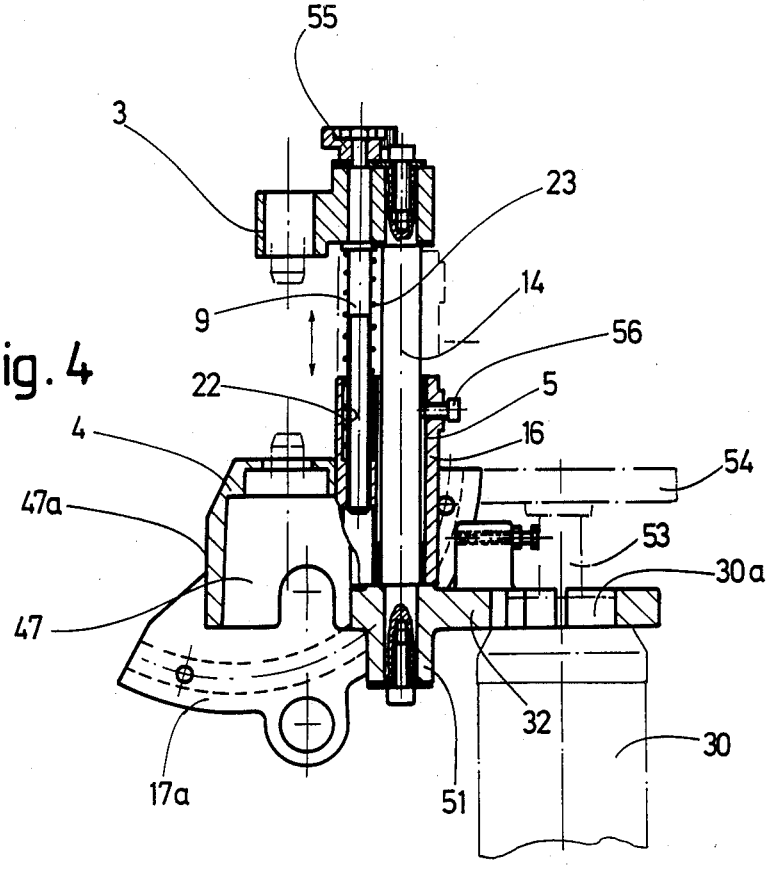
FIG. 4 is a vertical sectional view through a portion of the apparatus including the bearing assembly and carrier.

Between the two jaws (12), a sliding piece or carrier (17) is movably guided. The carrier (17) has two legs (42) abutting tightly against the jaws (12) of the slide (10). Outwardly directed curved projections (43) of the carrier engage guide slots (11) formed in the inner side of the jaws (12). Each guide slot (11) has the configuration of a circular arc as depicted in FIG. 3. The center of curvature (13) of the slots (11) defines a pivot axis for the carrier (17), which axis preferably lies on the surface of the table (6A).

Guide sleeves (16) are fixedly connected to the carrier (17). Rods (14, 15) are slidably guided without radial clearance in the sleeves. The lower ends of the rods (15) are fixedly connected to a yoke-like body forming part of a lower leg or head (4) of the bearing assembly, as described in more detail below.

The upper ends of the rods (14 and 15) are fixedly connected with an upper leg or head (3) which has the configuration of a yoke. The rods (14, 15) pass through a passage (35) in the table (6A).

The lower bearing head (4) carries a lower bearing (44A) which holds a milling spindle (28). The spindle is drawn upwardly by a threaded bolt (45). The bolt (45) also presses an axially displaceable stub shaft (44) tightly against the milling tool (2) and presses the latter simultaneously against a suitable cone (46) of the milling spindle (28), to entrain the tool for rotation with the spindle.

Figure 5:
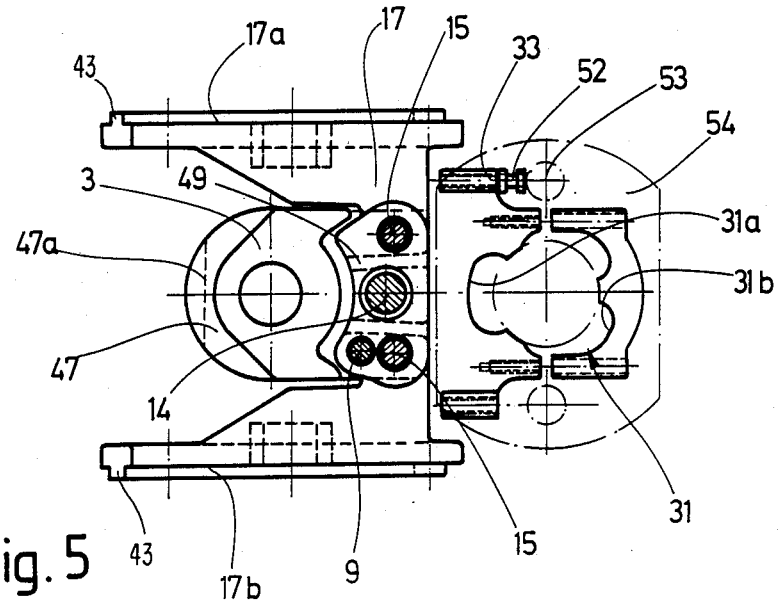
FIG. 5 is a plan view of the sliding piece of FIG. 4.

The stub shaft (44) is held in a suitable bearing (44B) in the upper leg (3). The bolt (45), spindle (28), and stub shaft (44) form a tool axle assemble which is driven about an axis (8) by a drive mechanism. In that regard, the lower bearing head (4) is extended downwards in the manner of a skirt and has lateral walls (47) surrounding a belt pulley (48) fixedly connected with the spindle (28) and a drive belt (29) slung around the pulley (48). The drive belt (29) passes through downwardly open slots (49) in the carrier (17) and is looped around an output shaft (50) of a drive motor (30). The drive motor (30) has a bearing collar (30a) held in a recess (31) of an arm (32) of the lower leg. The arm extends rigidly from a connecting piece (51) of the bearing head (4) in a direction facing away from the belt pulley (48). The arm (32) may comprise two clamping pieces, with one part (31*a*) thereof (FIG. 5) fixedly connected with the part (51), while the other part (31*b*) may be screwed to the part (31*a*). The two parts together form a recess (31) in which the motor may be clamped.

The arm (32) is additionally provided with a tensioner (33) to adjust the tension of the belt. Support screws (52) are held on the part (31*a*) of the arm (32) and have heads pressing against upper end (53) of the output shaft of the drive motor (30). A support plate (54) is fixed to that output shaft and abuts against the underside of the plate (37). The tension of the belt (29) may be adjusted by means of the screws (52). The part (31*b*) is thereafter fastened.

The bearing heads (3 and 4) as interconnected by the rods (14, 15) form a generally U-shaped bearing block or bearing assembly, with the heads (3 and 4) forming generally parallel legs of the U-shape. The columns (14 and 15) are adjustably displaceable upwards and downwards in the sleeve (16) of the carrier (17) and are adjustably held at adjusted locations therein by locking screws (56).

An adjusting bolt (9) is connected in an axially stationary manner with the upper bearing head (3). The bolt (9) is connected fixedly in rotation with a manually actuable adjusting wheel (55) and is threadedly connected at (22) to one of the sleeves (16) of the carrier (17). By rotating the adjusting bolt (9), which may be carried out simply by actuating the manual wheel (55), the bearing block may be displaced vertically, relative to the carrier (17), along with the columns (14 and 15) which slide in the guide sleeves (16), after the corresponding locking screws (56) are loosened. Thus, the height of the milling tool may be adjusted relative to the work bench (6) in a simple manner. By actuating the nut (26), the slide (10) and tool (2) may also be adjusted in a direction parallel to the table (6A).

In the case of a vertical adjustment in height of the bearing block (3, 4, 14, 15), by means of the adjusting wheel (25), the entire drive mechanism (29, 30) is also displaced, as the latter is fastened to the lower leg (4).

An adjusting shaft (18) is supported rotatably in ears (57) of the legs (42) of the carrier (17). The shaft (18) is connected fixedly at one end with a manually actuable wheel (19). An opposite end of the shaft (18) carries a toothed pinion (20), the pinion engaging a circular arch shaped toothing (21) on the outer edge of one of the jaws (12). The manual wheel (19) is located far enough to the outside, so that it projects past the lateral edges of the work bench (6) for convenient access. If the inclination of the tool axis (8) is to be set, the carrier (17) is pivoted between the jaws (12) of the slide (10) by the actuation of the manual wheel (19). Thus, the carrier (17) slides around the pivot axle (13), until for example, the stub shaft (44) reaches a terminal position (44') indicated in FIGS. 1, 3. The milling axis (8) then occupies the position (8') (FIG. 3), in which it forms an angle of approximately 25° with the table (6A) of the bench (6). The passage (35) in the table (6A) is large enough so that this pivot position can be attained. The configuration of the carrier (17) is such as to make possible the attainment of this extreme pivoted position. To promote this adjustment, a side (47*a*) of the walls (47) is flattened. The location of the motor (30) remotely of the table provides the advantage that the relatively bulky motor does not impede the pivoting motion by striking parts of the table.

A compression spring (23) is placed around the adjusting bolt (9), which ensures that the upper bearing head (3) is always biased upwards, away from the table (6A). The distance of the bearing head (3) from the upper edge of the sleeve (16) can therefore be adjusted only by actuating the adjusting spindle (9).

A feeler member (34) is mounted on the upper leg (3) and is adjustable by a threaded knob (34A) in a direction which is radial relative to the axis (8). The feeler member is adapted to contact a guide plate (not shown) which cams the tool for a copying action in a conventional manner.

It will be appreciated that the members (3, 4, 14, 15), form a bearing block assembly which is carried by the carrier (17) and which is vertically adjustable relative to the carrier (17) by means of the knob (55). The carrier (17), in turn, is mounted on the slide (10) for rotation relative to the guide within a vertical plane containing the tool axis (8), such rotation created by turning of knob (19). The slide (10) is horizontally slidable relative to the work bench in response to rotation of the knob (41). By means of this configuration, in which the adjusting controls for the milling assembly are no longer located under the table but rather are more readily accessible, it is possible in a simplified manner to actuate the controls from above the work bench, especially for adjusting the height of the milling cutter. A more simplified operation, also making possible more accurate milling operations, is thereby created.

Although the present invention has been described in connection with a preferred embodiment of the invention, it will be appreciated by those skilled in the art that additions, substitutions, modifications, and deletions not specifically described may be made, without departing from the spirit and scope of the invention as defined in the appended claims.

What is claimed is:

1. A milling apparatus comprising:

a work bench having a work table with a passage therethrough, a carrier operably connected to said work bench for rotation relative thereto within an upright plane, said carrier including a first portion disposed beneath said table and a second portion disposed above said table, a bearing block assembly carried by said carrier and including:

a lower leg carrying a lower bearing;

an upper leg carrying an upper bearing aligned with said lower bearing, said upper and lower legs spaced apart, with said upper portion of said carrier disposed therebetween, a tool axle lying in said upstanding plane and mounted in said upper and lower bearings, and drive means for driving said tool axle about an axis, said bearing block assembly extending through said passage and arranged such that said lower leg is disposed below said table, and said upper leg is disposed above said table, said bearing block assembly being connected to said carrier for vertical linear adjustment relative to said carrier, first manually actuable means disposed above said table for effecting said vertical linear adjustment of said bearing block assembly, and second manually actuable means for effecting said rotation of said carrier relative to said table.

2. Apparatus according to claim 1, wherein said first manually actuable means is mounted on said upper leg.

3. Apparatus according to claim 1 including a slide connected to said work bench for linear movement relative thereto in a generally horizontal direction, said carrier being pivotably connected to said slide such that said slide constitutes means for operably connecting said carrier to said work bench for said rotational movement, and third manually actuable means for effecting said linear movement of said slide.

4. Apparatus according to claim 3, wherein said slide is situated beneath said table.

5. Apparatus according to claim 4, wherein said slide includes guide means for guiding said carrier during said rotation thereof.

6. Apparatus according to claim 5, wherein said slide includes two downwardly depending jaws, said lower portion of said carrier disposed between said jaws, said guide means comprising curved slots within which are disposed projections of said carrier, said slots defining an axis of rotation for said carrier, said axis disposed no higher than an upper surface of said table.

7. Apparatus according to claim 1, wherein said second portion of said carrier comprises an upright sleeve, said connector means comprising rod means slidably disposed in said sleeve.

8. Apparatus according to claim 3, wherein said second manually actuable means comprises a manually rotatable shaft mounted on said carrier and a pinion rigidly affixed to said shaft, said slide including an arc carrying a plurality of teeth engaged by said pinion to propel said carrier along said slide.

9. Apparatus according to claim 7, wherein said first manually actuable means comprises a threaded bolt rotatably mounted in said upper leg and threadedly connected in said sleeve.

10. Apparatus according to claim 9 including spring means biasing said upper leg away from said sleeve.

11. Apparatus according to claim 3, including a threaded spindle attached to said slide and projecting through a wall of said bench, said wall carrying threads which threadingly engage said threaded spindle for displacing said slide.

12. Apparatus according to claim 11, wherein said wall comprises a vertically oriented edge of said work bench, a knob rotatably mounted on an outer surface of said wall and carrying said threads, said threaded spindle projecting through said knob such that said slide is displaced in response to rotation of said knob.

13. Apparatus according to claim 1, wherein said drive means is mounted on said lower leg.

14. Apparatus according to claim 13, wherein said drive means comprises a motor and a belt operably connected between said motor and said tool spindle.

15. Apparatus according to claim 14, wherein said lower leg includes a recess, said motor being mounted in said recess such that an output shaft of said motor projects through said recess to an opposite side of said lower leg for engagement with said belt.

16. Apparatus according to claim 15, wherein said output shaft is oriented to extend toward said table.

17. Apparatus according to claim 16, wherein said lower leg includes a releasable clamp for holding said motor.

18. Apparatus according to claim 15 including tensioning means carried by said lower leg for tensioning said belt.

19. Apparatus according to claim 14, wherein said carrier includes slot means, said belt passing through said slot means so as to be movable relative to said carrier in a direction transverse to the direction of belt rotation in response to actuation of said first manually actuable means.

20. Apparatus according to claim 1 including a milling tool mounted on said tool axle and a curved feeler element mounted on said upper leg.

21. Apparatus according to claim 20, wherein said feeler element is adjustable in a direction radially of said spindle axis.

22. Apparatus according to claim 3, wherein said slide includes a flat surface bearing against an underside of said table.

23. A bearing module adapted to carry a motordriven tool axle and to be connected to the underside of a work bench table such that the axle projects upwardly through a passage in the table, said bearing module comprising:

a base adapted to be mounted to a work bench table so as to be disposed therebeneath, a carrier carried by said base, a bearing block assembly carried by said carrier and including:

a lower leg having means for carrying a lower bearing, an upper leg having means for carrying an upper bearing in alignment with said lower bearing to define therewith an axis for a tool axle, said upper leg including means for carrying an axle drive motor, and an upstanding connector interconnecting said upper and lower legs, said upper and lower legs disposed on opposite sides of said carrier, said carrier being carried by said base for rotation relative to said base within an upright plane containing said axis for adjusting the inclination of said axis, said bearing block assembly being connected to said carrier for linear adjustment relative thereto within said plane, first manually actuable means for effecting said linear displacement of said bearing block assembly, and second manually actuable means for effecting said rotation of said carrier relative to said base.

24. A module according to claim 23, wherein a drive motor is attached to said lower leg such that an output shaft thereof extends parallel to said axis, a belt connects said output shaft to said axle and passes through a slot in said carrier so as to be movable relative thereto in a direction transversely of the direction of belt rotation in response to actuation of said first manually actuable means.

* * * * *